United States Patent [19]

Hirooka

[11] Patent Number: 4,579,405

[45] Date of Patent: Apr. 1, 1986

[54] AC POWER CORD

[75] Inventor: Mitsuo Hirooka, Yao, Japan

[73] Assignee: Sharp Kabushiki Kaisha, Osaka, Japan

[21] Appl. No.: 620,008

[22] Filed: Jun. 12, 1984

[30] Foreign Application Priority Data

Jun. 17, 1983 [JP] Japan ..... 58-93554[U]
Mar. 21, 1984 [JP] Japan ..... 59-40676[U]

[51] Int. Cl.[4] ..... H01R 4/66
[52] U.S. Cl. ..... 339/14 L; 339/103 R
[58] Field of Search ..... 339/13, 14, 84, 61 M, 339/101, 103 B, 108 R, 110 P, 126 R

[56] References Cited

U.S. PATENT DOCUMENTS 3,381,258 4/1968 Becker ..... 339/14 P
3,739,317 6/1973 Wise ..... 339/14 P
4,071,872 1/1978 Phillips ..... 339/14 P X

*Primary Examiner*—Eugene F. Desmond
*Attorney, Agent, or Firm*—Birch, Stewart, Kolasch & Birch

[57] ABSTRACT

An AC power cord assembled in the plastic-molded bushing unit that has a groove engaged with the edge of an open space which is formed through the wall of the installation base and contains a plurality of electric lines of the AC power cord including the earth line. The bushing unit also provides an earth terminal which is connected to the earth line and integrally formed in and held by the bushing unit. As a result, by externally securing the main unit with a screw, assembly work can be easily and conveniently performed, thus significantly reducing the cost.

6 Claims, 5 Drawing Figures

AC POWER CORD

BACKGROUND OF THE INVENTION

The present invention relates to an improved AC power cord having a 3-pin plug.

FIG. 1 indicates a simplified diagram showing the state of installing a conventional AC power cord provided with a 3- pin plug. Typically, such a conventional AC power cord 5 connected to a 3-pin plug 4 comprising an earth terminal 1, a hot terminal 2, and a neutral terminal 3, is installed, for example, to the rear panel 7 of a main unit 6 via a bushing 8, whereas the earth line 9 of the AC power cord 5 is secured, for example, to the bottom plate 10 of the main unit 6 with a grounding screw 11.

In other words, the earth line 9 in the main unit 6 should be grounded only after securing the AC power cord 5 with a bushing 8, thus requiring at least two processes to be done. In addition, since the AC power cord 5 cannot be easily positioned due to a specific structure of the bushing 8 when securing the cord to the main unit 6, the AC power cord installation work cannot be smoothly performed.

OBJECT AND SUMMARY OF THE INVENTION

The present invention primarily simplifies the installation procedure by simultaneously securing the AC power cord and the earth line to the bushing and the main unit via a single process. The present invention also improves working efficiency of the installation procedure by externally securing the earth line outside the main unit.

The present invention provides a preferred embodiment including; a groove being coupled with the edge portion of an open space formed through the wall of a main unit, a plastic-molded bushing unit containing three lines of the AC power cord including the earth line, and the earth fixing terminal being connected to the earth line and integrally formed and held inside the bushing.

DETAILED DESCRIPTION OF THE INVENTION

With reference to the attached drawings, the preferred embodiment of the present invention is described below.

Figure 1:
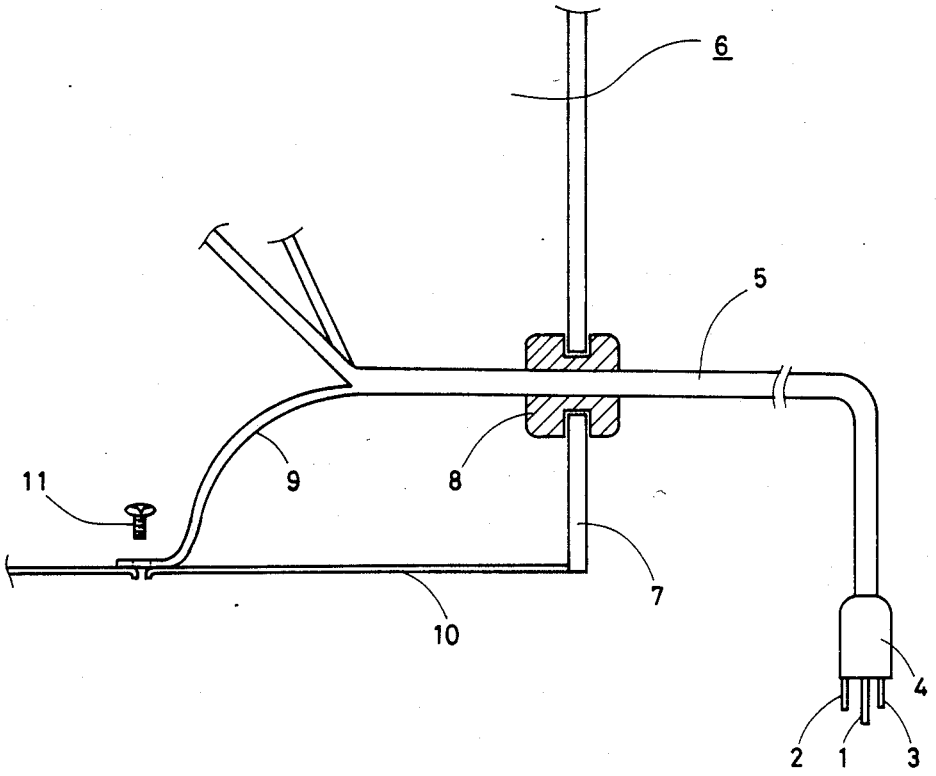
FIG. 1 is a simplified diagram showing the state of installing a conventional AC power cord with a 3-pin plug.
Figure 2:
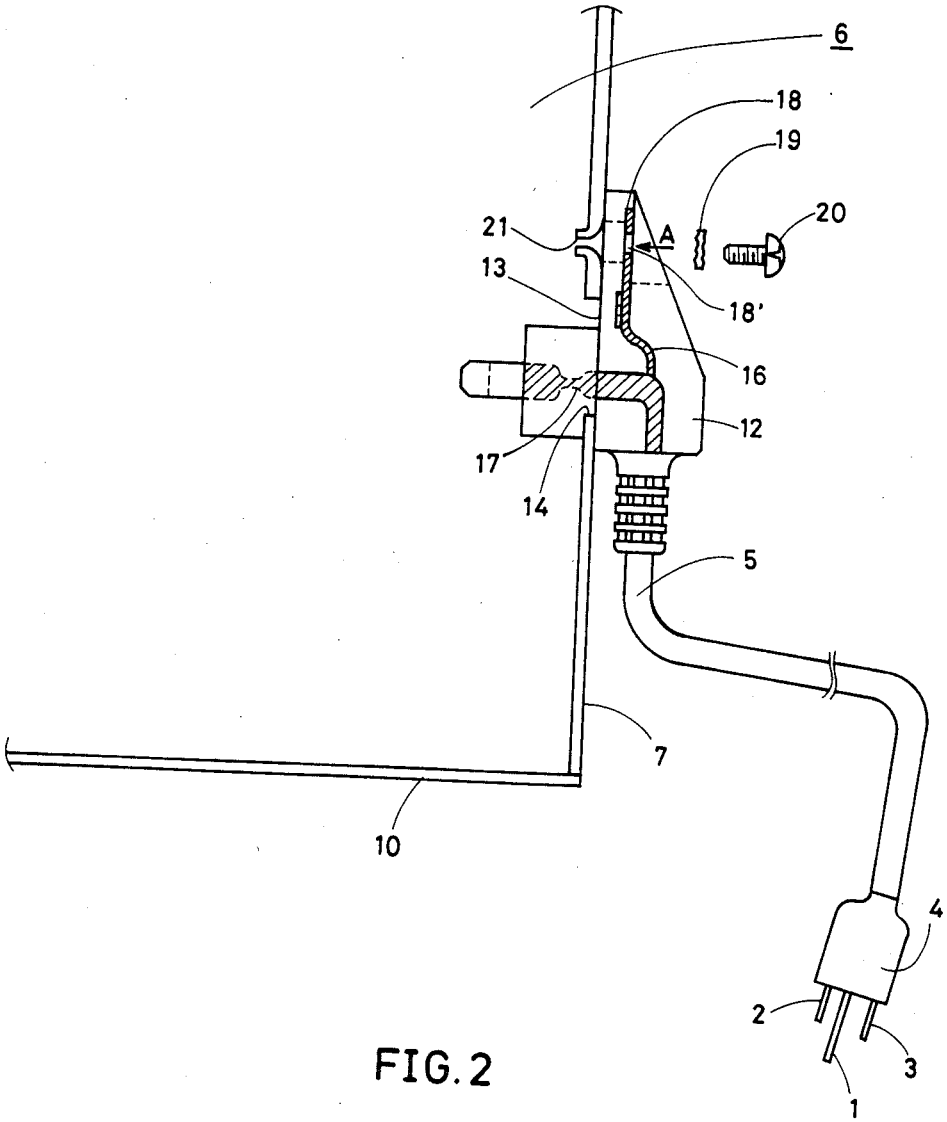
FIG. 2 is a simplified diagram showing the state of installing the AC power cord as the preferred embodiment of the present invention.
Figure 3:
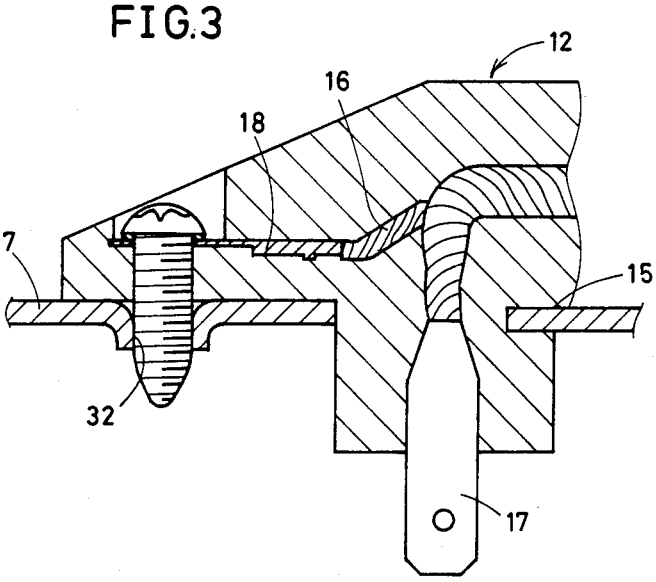
FIG. 3 is an enlarged view of the main part of the bushing unit of the AC power cord shown in FIG. 2.

FIG. 2 indicates a simplified diagram showing the state of installing the AC power cord as the preferred embodiment of the present invention. FIG. 3 indicates the enlarged view of the main part of the bushing unit of the AC power cord shown in FIG. 2. Those portions of FIG. 2 which have the same functions as those of the conventional unit shown in FIG. 1 are indicated by the identical reference numbers. The detailed description for these have, therefore, been deleted.

In FIGS. 2 and 3, reference number 12 indicates the plastic-molded AC power cord bushing that contains a groove 15 being coupled with the edge 14 of an open space 13 formed through the rear panel 7 of the main unit 6 as well as the earth line 16, hot and the neutral power line 17 of the AC power cord 5.

Reference number 18 indicates the earth fixing terminal which is connected to the earth line 16 and secured to the molded plastics of the bushing 12. This terminal is secured to the tapered hole 21 which is formed through the rear panel 7 of the main unit 6 with a tapping screw 20 via a washer 19 in the arrowed direction A.

Accordingly, since the earth fixing terminal 18 is mechanically secured to the rear panel 7, this terminal will remain at the same electrical potential as that of the earth line 16 of the AC power cord 5, and as a result, the main unit 6 will remain at the grounding potential.

A method for securing the AC power cord 5 to the main unit 6 is described below.

First, the AC power cord bushing 12 is inserted into an open space 13 of the rear panel 7 of the main unit 6, and then the groove 15 of the AC power cord bushing 12 is engaged with the edge 14 of the open space 13 so that the bushing 12 can be correctly positioned. This allows the installation hole 21 in the upper part of the open space 13 to perfectly match the screw hole 18' of the earth fixing terminal 18. Next, the tapping screw 20 is inserted into the screw hole 18' via washer 19, which is then secured to the installation hole 21 so that the earth fixing terminal 18 can be secured to the rear panel 7 of the main unit 6, and at the same time, the bushing 12 is also secured to the rear panel 7. As a result, the AC power cord bushing 12 is secured to the main unit 6 by the tapping screw 20 inserted into the screw hole 18' provided in the earth fixing terminal 18.

As described above, the preferred embodiment of the present invention porvides that the bushing unit 12 that contains a groove being engaged with the edge of an open space formed in the wall of the main unit in addition to the plastic-molded three lines of the AC power cord includng the earth line, and the earth fixing terminal which is integrally formed and held inside the bushing unit and being connected to the earth line. Consequently, the AC power cord bushing is securely installed to the main unit by externally securing the earth fixing terminal to the wall of the main unit vai a screw and a washer. This allows the earth line of the AC power line to be simultaneously grounded onto the main unit, thus making it possible to easily and securely install the AC power cord.

In the preferred embodiment of the present invention shown in FIG. 2, it should be noted that, since such portions located between the earth terminal 18 of the bushing unit 12 and the rear panel 7 are totally composed of plastic material, it is probable that the installed earth terminal 18 may be loosened as time goes by due to degradation of plastics, which will eventually cause the earth to incorrectly function.

Figure 4:
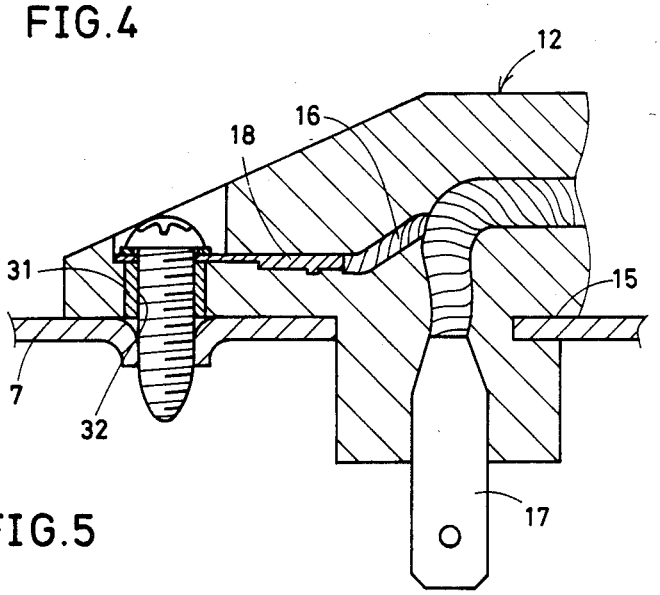
FIG. 4 is a sectional view of the main part of the bushing unit containing the AC power cord as another preferred embodiment of the present invention.

FIG. 4 shows another preferred embodiment of the AC power cord. Such parts and portions identical to those which are shown in FIGS. 1 through 3 are indicated by the identical reference numbers, and the detailed descriptions of these have, therefore, been deleted.

Figure 5:
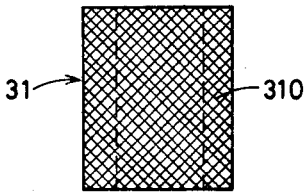
FIG. 5 is a front view of the reinforcing ring of the AC power cord shown in FIG. 4.

In FIG. 4, reference number 31 indicates a ring composed of metal such as brass. There is a roulette 310 being formed around the metal ring, which is either of coarse surface or the one shown in FIG. 5. It is internally held at position located between the earth terminal 18 and the rear panel 7 of the bushing unit 12 as the reinforcing unit concentrically with the screw hole 32. The metal ring 31 may be compulsorily inserted in the designated position after completing the formation of the bushing unit 12. However, it is more preferrable to concurrently install the metal ring when forming the bushing unit 12 in order to improve the productivity.

Using the metal ring 31 thus reinforced, even if the plastic material located between the earth terminal 18 and the rear panel 7 may have degraded itself, the earth terminal can be securely held by the reinforced effect of the metal ring 31, thus preventing the earth from improperly functioning. In addition, since the second preferred embodiment permits the roulette 310 to be formed around the metal ring 31, the metal ring can always be tightly held against the plastics, and as a result, even the slightest slack can be securely prevented. Such a ring may be composed of any metal other than brass and it may also be composed of any substitutive material other than metal.

What is claimed is:

1. A system for simultaneously securing an AC power cord including an earth line to an electrical device, comprising:

a main housing receiving said electrical device and including a panel, said panel having an opening formed therein for receiving said power cord therethrough;

an insulated bushing formed on said AC power cord, said bushing having a base juxtaposed with said panel and extending into said opening, said base including a notch which engages an edge of said opening and positions said bushing on said panel;

an earth terminal, connected to said earth line of said AC power cord, to provide a ground to said electrical device; and means for securing said earth terminal to said panel to electrically connect said earth terminal to said device through said panel;

said means for securing and the engagement of said notch with the edge of said opening collectively secure said bushing to said panel.

2. The system according to claim 1, wherein said earth terminal is integrally formed within said bushing.

3. The system according to claim 1, wherein said bushing is an insulated plastic molded unit.

4. The system according to claim 1, wherein said means for securing said earth terminal is a screw and washer assembly inserted through said bushing and said earth terminal to said panel.

5. The system according to claim 4, wherein said means for securing said earth terminal further includes a conductive cylindrical support positioned between said panel and said earth terminal within said bushing.

6. The apparatus according to claim 1, wherein said AC power cord is secured by and extends through a portion of said bushing.

* * * * *